US005630452A

United States Patent [19]

Schmid et al.

[11] Patent Number: 5,630,452

[45] Date of Patent: May 20, 1997

[54] FUNNEL WITH LEVEL INDICATOR

[76] Inventors: Dieter Schmid, Radaustrasse 23a, 86199 Augsburg; Oliver Schmid, Grundweg 2, 86356 Neusass, both of Germany

[21] Appl. No.: 500,881

[22] PCT Filed: Mar. 29, 1994

[86] PCT No.: PCT/EP94/00980

§ 371 Date: Jul. 11, 1995

§ 102(e) Date: Jul. 11, 1995

[87] PCT Pub. No.: WO94/25390

PCT Pub. Date: Nov. 10, 1994

[30] Foreign Application Priority Data

| | | | |
|---|---|---|---|
| Apr. 30, 1993 | [DE] | Germany | 9306567 U |
| Jul. 8, 1993 | [DE] | Germany | 9310141 U |
| Oct. 12, 1993 | [DE] | Germany | 9315446 U |

[51] Int. Cl.[6] ..... B65B 1/04

[52] U.S. Cl. ..... 141/199; 141/331; 141/339; 141/340

[58] Field of Search ..... 141/199–205, 141/331–345, 297–300, 95

[56] References Cited

U.S. PATENT DOCUMENTS

| | | | |
|---|---|---|---|
| 530,690 | 12/1894 | James | 141/335 |
| 1,303,890 | 5/1919 | Gustafson | 141/336 |
| 1,333,756 | 3/1920 | Heimgartner | 141/95 |
| 2,689,651 | 9/1954 | Horsdal | 141/331 |

FOREIGN PATENT DOCUMENTS

| | | |
|---|---|---|
| 2428018A1 | 1/1976 | Germany . |
| 81068026 | 8/1981 | Germany . |
| 8706106.6 | 9/1987 | Germany . |
| 9014561.5 | 1/1991 | Germany . |

*Primary Examiner*—David J. Walczak
*Assistant Examiner*—Steven O. Douglas
*Attorney, Agent, or Firm*—McClew & Tuttle

[57] ABSTRACT

A special design of a funnel for filling liquids safely especially into nontransparent containers, e.g., fuel tanks of lawn mowers. To indicate the filling level of the container, a measuring rod of a float is guided in a perforated plate of the funnel. Passage slots, through which the liquid filled into the funnel can enter the container, are located in the funnel tube under the perforated plate. Due to buoyancy, the float strikes the underside of the perforated plate, and as a result it prevents the container from being overfilled.

20 Claims, 4 Drawing Sheets

FUNNEL WITH LEVEL INDICATOR

FIELD OF THE INVENTION

The present invention pertains to a funnel with a level indicator for filling liquids into containers safely and including a mount for a measuring rod. The mount passes transversely through the funnel tube, wherein the measuring rod is guided along the axis of the funnel and carries under the mount a piston-like float acting as a lifting element that is movable in the funnel tube. A plurality of passage slots for the liquid to be filled in are located in the wall of the funnel tube, and the movement of the measuring rod is limited in both directions.

BACKGROUND OF THE INVENTION

Such an arrangement has become known from DE-GM 75 29 052. Attention was called there to the problem associated with the filling of larger amounts of solvents, which is linked with the determination of the liquid level or the amount in nontransparent vessels and especially with the prevention of overflow.

In this prior-art solution, the mount passing through the funnel tube consists of a disk, which has a central hole and is located relatively in the lower area of the funnel tube. Under the disk, a measuring rod guided in the disk has a float. The float's buoyancy caused by the liquid filled into the vessel is recognizable from the movement of the measuring rod. In the upper area, this measuring rod has a plate-like indicating means, which signals that the container has been sufficiently filled when a defined level has been reached in relation to the wall of the flare of the funnel.

The problem of this level indicator means is that the passage slots are located above the mount transversely passing through the funnel tube. Liquid can therefore be filled unhindered into the funnel when the float has already reached its topmost position. The liquid then continues to pass as before, into the container through the passage slots. As a consequence of which, the buoyancy of the float causes the entire funnel to be lifted as well because the float comes into contact with the mount passing transversely through the funnel tube from below.

The level position of the measuring rod must therefore be carefully checked during filling in order to prevent the liquid being filled in from overflowing.

The present invention is based on this state of the art according to German Utility Model DE-GM 75 29 052, and has the task of improving the level indicator means such that it is not necessary to resort to the observation of the measuring rod alone, but additional indications for the filling level of the nontransparent container are also obtained, and that the filling especially of nontransparent containers and especially with fuel, is facilitated, in general.

SUMMARY AND OBJECTS OF THE INVENTION

It is an object of the present invention to provide a funnel with a level indicator for filling fluids safely into a non transparent container. The present invention accomplishes this by providing a float inside the funnel tube of a funnel. The float can move inside the funnel tube due to its buoyancy in the fluid in the container. A measuring rod is connected to the float and extends upstream from the float along an axis of the funnel tube, and extends out into the funnel flare of the funnel. A perforated plate mounted at a connection between the funnel tube and the funnel flare surrounds and guides the measuring rod along the axis of the funnel tube. The perforated plate, the funnel tube, and the funnel flare are designed so that the perforated plate is repetitively replaceable in the funnel without damaging or destroying the funnel or requiring special tools. The funnel tube also defines passage slots on the radial surfaces of the funnel tube. These passage slots are positioned downstream of the perforated plate.

The liquid is thus filled from the flare of the funnel through the perforated plate into the funnel tube, from which it can enter the container through the passage slots. When the float according to the present invention has reached its top end position due to the buoyancy of the liquid, it covers the perforations in the perforated plate from below, so that the liquid filled in will immediately accumulate above the perforated plate.

Thus, the final filling level of the liquid in the container is recognized from the level position of the measuring rod, and also by the accumulation of liquid in the flare of the funnel. The accumulated liquid can then enter the container with ease when the funnel is slightly raised, because the float does not participate in this lifting movement.

The funnel tube can have a screw socket means which attaches the funnel tube to a tank cap of a container or fuel tank. The screw socket means will generally have internal threads which engage with the external threads of the tank cap. The screw socket means can either be a one piece injection-molded plastic part with the funnel tube, or can be designed as a union nut which is rotatable with respect to the funnel tube, and threading of the union nut onto the tank cap clamps a collar on the funnel tube between the union nut and the tank cap. It is also possible to make the funnel flare portion removable from the funnel tube, and yet keep the funnel tube inside the container or tank. The perforated disk remains attached to the funnel tube, and a holder means is incorporated onto the funnel tube to hold a transparent cap which covers the upstream end of the funnel tube and the measuring rod in a fluid tight manner. It is then easy to see if the container is full. The complete funnel screwed to the tank with the screw socket means is held securely and does not need to be manually held. The funnel flare can remain on the container when the transparent cap is attached, or the funnel flare can be removed when it is not being used to fill the container.

Even though it has been known from GB-A 2 081 128 and U.S. Pat. No. 2,689,651 that a perforated plate may be arranged in the funnel, and that this perforated plate is also designed as a guide for a measuring rod in the case of U.S. Pat. No. 2,689,651, the effect according to the present invention cannot be achieved with this arrangement.

The funnel according to the present invention may be used, in principle, when a liquid is filled especially into nontransparent containers. The object of the present invention is of particular significance in the case of filling fuels into engine-powered working implements, especially lawn mowers, which are powered by internal combustion engines. The additional problem that arises there is that the fuel being filled in must be prevented from overflowing especially in order to prevent the ignition of the liquid on the hot working implement. However, the present invention does not depend on whether the container is transparent or nontransparent.

Centering and sealing of the float in its top position is improved as a consequence of a dome-shaped design of the float and of the perforated plate. As a result of which the openings located in the perforated plate are closed under the action of the buoyancy of the float more or less abruptly, and liquid will immediately accumulate above the perforated plate. Therefore, there can be no doubt about the observation that the container has been properly filled.

An additional indication for recognizing the imminent end of the filling process is also provided by structure of the present invention. In conjunction with the position of the passage slots, a circular gap provided between the float and the funnel tube has the action of a throttle, because when the float is approaching its top end position due to the buoyant effect of the liquid, the flow rate of the liquid through the perforated plate decreases. This is recognizable by the operator from the liquid level dropping more slowly in the flare of the funnel. The operator is therefore warned in advance that the filling process will soon come to an end and therefore he must proceed cautiously with the continued filling of the flare of the funnel.

In a lower end position, the float strikes a stop, which is arranged such that the measuring rod still projects by a certain length over the perforated plate.

It was found to be advantageous for the measuring rod of the float to be first led through the suitable hole of the perforated plate while the assembly is outside the funnel and before the perforated plate with the float arrangement is brought into its working position.

If the individual passage slot in the funnel tube is designed to have a larger expansion opening just upstream of the float when the float is at its most downstream position, the flow pressure acting on the float can be reduced and more rapid flow through the passage slots can be achieved. An opening in the tube wall suitable for hanging the funnel on a hook is also obtained at the same time.

The features of the present invention also ensure that the filling of liquid into the container or the consumption of the liquid contained in the container does not cause any problems related to excess pressure or vacuum.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
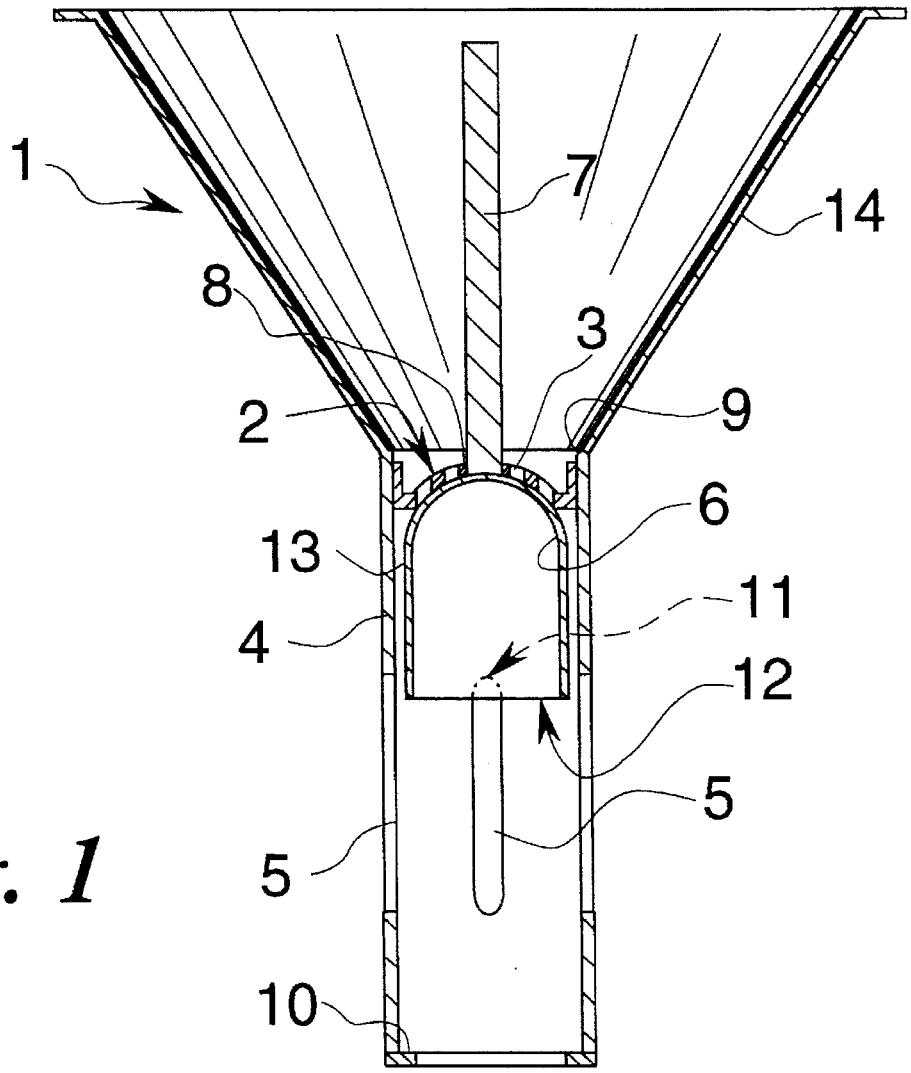
FIG. 1 shows a vertical section through a funnel.

The funnel 1 consists of the funnel flare 14 and the funnel tube 4 joining it in the downward direction. In the transition area from the funnel flare 14 to the funnel tube 4, the funnel tube 4 is traversed by a perforated plate 2, through the holes 3 of which the liquid filled into the funnel flare 14 can flow down.

The perforated plate 2 has a central hole 8, through which a measuring rod 7 of a float 6 passes in the upward direction. The position of the float 6 shown in FIG. 1 is the top end position. This position is reached when a nontransparent container has been filled with liquid by means of the funnel 1. The buoyant power or force of the liquid presses the float 6 in the upward direction, until it comes into contact with the underside of the perforated plate 2.

When the container is empty, the float 6 is in its lower position. The lower edge 12 of the float 6 comes into contact with the step 10 of the funnel tube 4 and is retained by same. In this lower position of the float 6, the measuring rod 7 still projects slightly above the perforated plate 2.

In addition, it is recognized from the drawing that a few passage slots 5, which are arranged under the perforated plate 2, contrary to the state of the art, are located in the funnel tube 4. The liquid filled into the funnel flare 14 therefore first enters the funnel tube 4 through the perforated plate 2 one must imagine that the float 6 is in the lower position, not shown, after which it enters the container through the passage slots 5.

In a preferred exemplary embodiment of the present invention, the perforated plate 2 is arched upward in a dome-shaped design. The upper front side of the float 6 has a corresponding shape. In addition, the float 6 is designed as a hollow body, which is open on its underside. In conjunction with the dome-shaped design of the perforated plate 2 and the float 6, the buoyancy of the liquid flowing in causes a more correctly centered contact of the float 6 with the underside of the perforated plate 2. When the filling process has proceeded to the extent that the float 6 is in contact with the perforated plate 2 a very desirable sealing of the perforated plate against the float 6 is achieved with this arrangement, and liquid still being filled into the funnel flare accumulates above the perforated plate 2.

The arrangement of a circular gap 13 between the float 6 and the funnel tube 4 is also of particular significance in conjunction with the position of the upper edge 11 of the passage slot 5 in relation to the lower edge 12 of the float 6 in its topmost position.

As soon as the float 6 reaches a position during the filling of the container in which it covers the passage slots 5 from the inside more or less with a clearance, the flow rate of the liquid decreases, because it finds a throttle in the form of the circular gap 13 after passing through the holes 3 of the perforated plate 2.

The approaching end of the filling process is therefore immediately recognized from the rate of lowering of the liquid level in the funnel flare 14 during the filling of a nontransparent container.

When the float 6 assumes its top position shown in FIG. 1, no more liquid can escape in the downward direction, so that liquid will accumulate in the funnel flare 14. This accumulation has no adverse effect, because its volume is approximately equal to the volume of the part of the funnel immersed into the liquid. When the funnel 1 is slightly raised after the end of the filling process, the accumulated liquid can enter the container through the holes 3, because the float 6 does not participate in this lifting movement.

To facilitate the assembly of the float 6 and the perforated plate 2, it is recommended that the perforated plate 2 with the float 6 and the measuring rod 7 be pressed through the funnel flare 14 and into the funnel tube 4 from the top until the upper edge of the perforated plate 2 has passed over a circular bead 9, which has a snap-closing action. The perforated plate 2 therefore cannot readily escape in the upward direction under the lifting action of the float 6 and the impact of the float 6 against the perforated plate 2. However, replacement of the perforated plate 2 with the float 6 and the measuring rod 7 is possible at any time, e.g., for cleaning the unit or to insert another perforated plate 2 with holes 3 of a different design.

Figure 2:
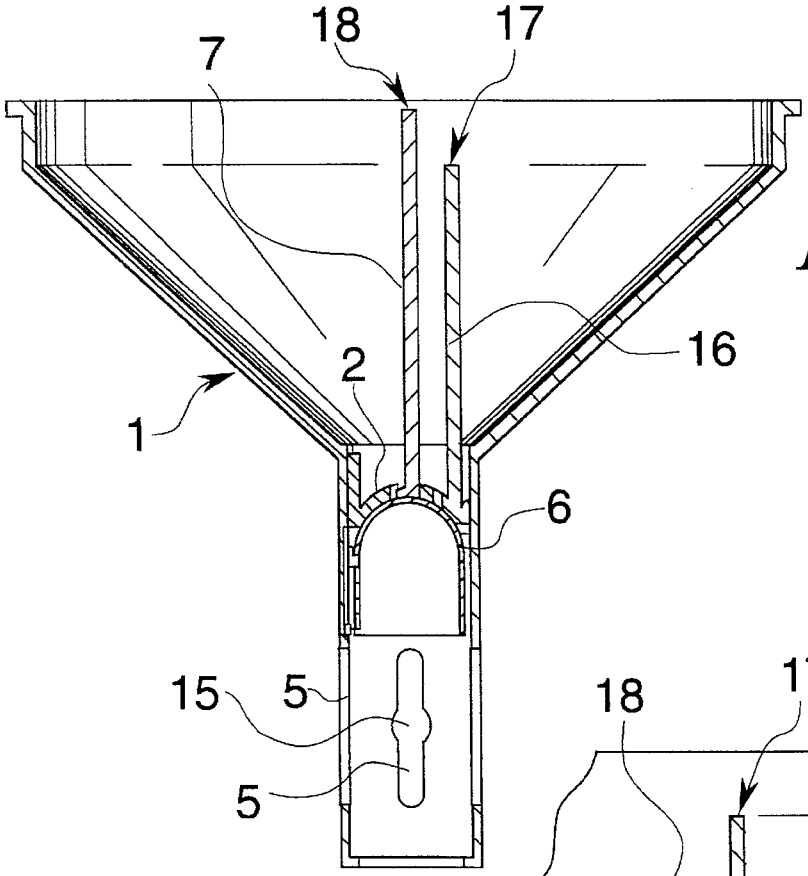
FIGS. 2 and 3 show a vertical section through another design of the funnel in two different positions of the float.
Figure 3:
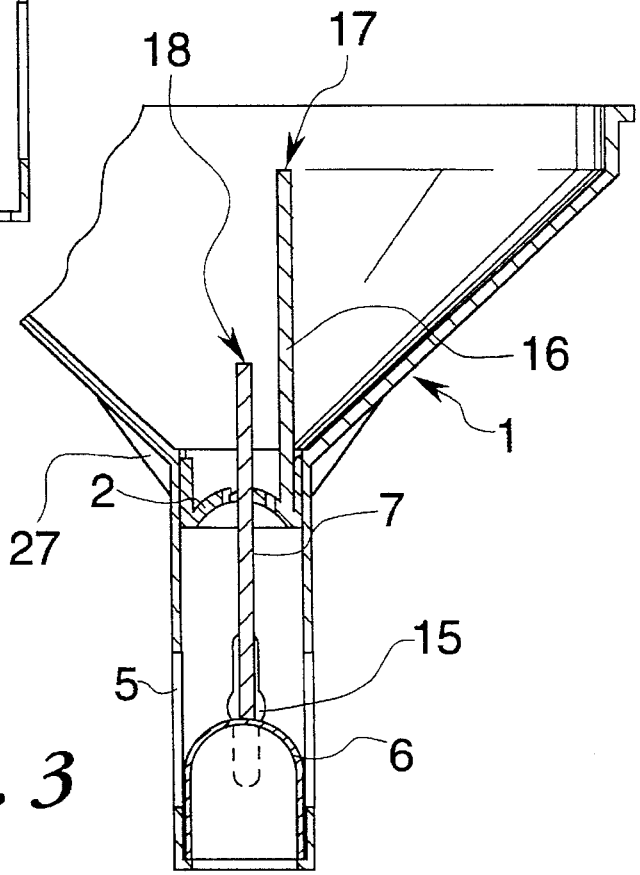

The exemplary embodiment according to FIG. 2 shows that the individual passage slot 5 has a round expansion 15 approximately in the middle area. As is shown in FIG. 3, this expansion 15 shall be located slightly above the float 6 when the float 6 assumes its lower position. The liquid reaching the expansion 15 exerts a reduced flow pressure on the float 6, because the liquid is able to flow off more rapidly as a consequence of the expansion of the slot. This expansion 15 may also be used to hang the funnel 1 on a hook, bolt or the like. The location of the expansion 15 should therefore be selected to be such that the float 6 cannot cover the expansion 15.

A vertical reference rod 16, which extends in parallel to the axis of the funnel, is located at the perforated plate 2 in the exemplary embodiment according to FIGS. 2 and 3. The top end 17 of this reference rod is somewhat lower than the top end 18 of the measuring rod 7 when the float 6 is in its topmost position. This provides an additional indication for determining that the filling process has been concluded.

FIG. 3 also shows the arrangement of vertical ribs 27 on the outer surface of the funnel flare 14, which are intended to form vent gaps between them, through which air, which may be compressed, can escape during the filling of the liquid into the container. These ribs 27 lie on the edge of the container filling opening and therefore enable compressed air to escape from the container.

Figure 4:
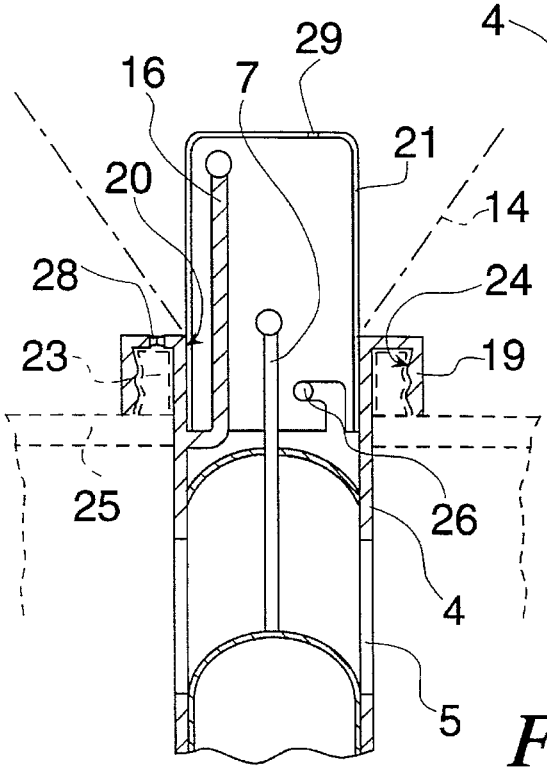
FIG. 4 shows a vertical section through a funnel tube with a screw socket located on it.

The exemplary embodiment according to FIG. 4 shows the connection of the funnel tube 4 to a screw socket 19 on a tank cap 23. The screw socket 19 consequently has internal threads 24 adapted to the tank cap 23. The funnel 1 or the funnel tube 4 can thus be firmly anchored on the container 25, and it is therefore possible to use both hands to hold the refueling container.

The screw socket 19 may be injection-molded together with the funnel tube 4 as a one-piece plastic part. However, it is also possible to design the screw socket 19 in the manner of a union nut and to have it act against a collar-like projection not shown of the funnel tube.

In the exemplary embodiment according to FIG. 4, the screw socket 19 or the funnel tube 4 has a holder 20 for pushing on a transparent cap 21. This cap surrounds the measuring rod 7 and—if present—the reference rod 16 in a moisture-proof manner, and prevents the liquid present in the container 25, especially fuels, from flowing out or evaporating. As a result, it is possible to leave the funnel tube 4 with the transparent cap permanently on the container 25, so that the level of the container 25 can be recognized at any time during the operation. This is important especially when the present invention is used in lawn mowers with internal combustion engines. The transparent cap 21 is secured in the holder 20 by a bayonet catch 26, but the latter may also be replaced with a threaded connection. In the case of the design according to FIG. 4, the funnel 1 may be present, but it is by no means necessary. As is apparent from FIG. 5, the funnel flare 14 may be used as a replacement element for the transparent cap 21. If the container 25 is to be filled, the transparent cap 21 is removed, and the funnel flare 14 is placed into the holder 20. After the end of the filling process, the funnel flare 14 may again be removed and be replaced with the transparent cap 21. In the example according to FIG. 5, the holder 20 is designed as an external threaded section, onto which either the funnel flare 14 or the transparent cap can be screwed.

However, the entry and discharge of air into and from the container 25 during the flowing of liquid into the tank and the consumption of the liquid from the tank should be ensured. In the example according to FIG. 4, the wall of the screw socket 19 has a vent hole 28, through which the air compressed during the filling process can escape from the container 25.

However, a vent hole 29, which is to enable outside air to enter the container 25 when the liquid is being consumed, e.g., while mowing the lawn, is also indicated in the transparent cap 21.

Figure 5:
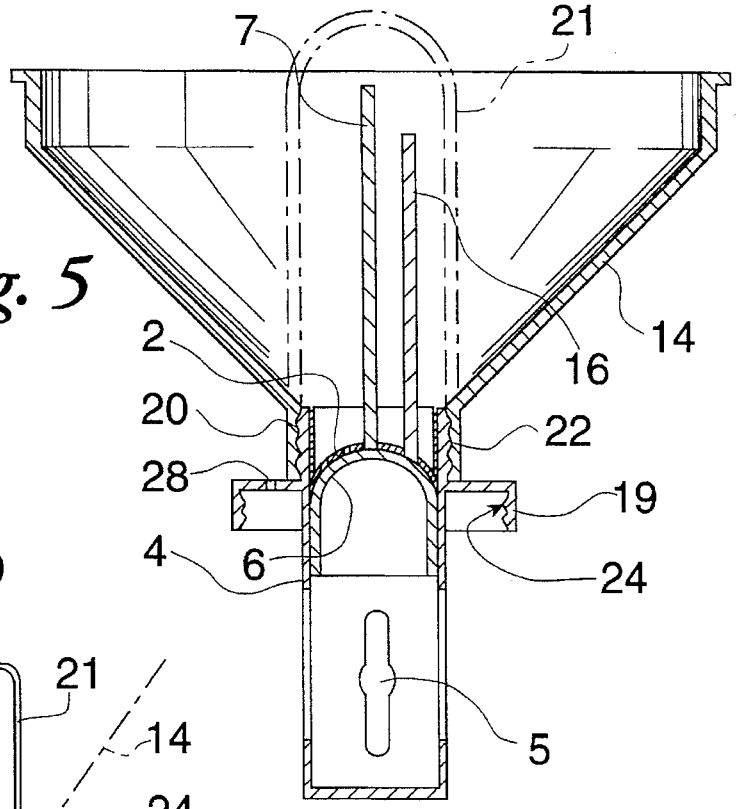
FIG. 5 shows a vertical section through a removable funnel.
Figure 6:
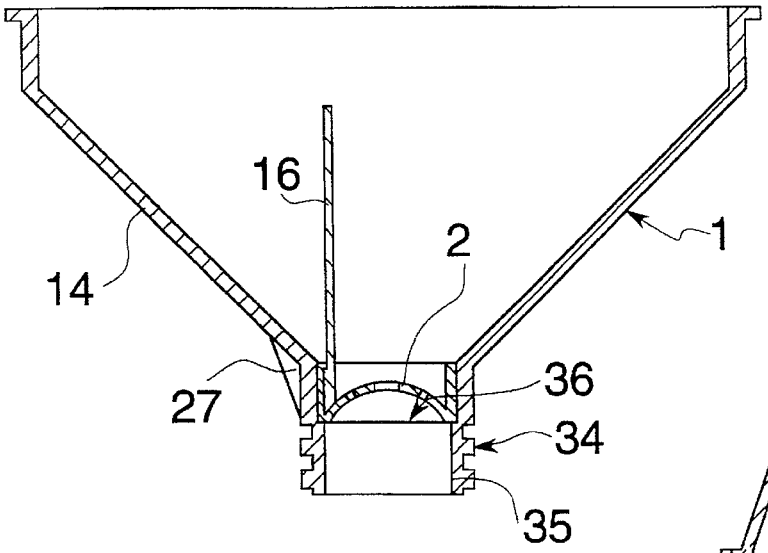
FIG. 6 shows a vertical section through a funnel as an alternative to FIG. 1.
Figure 7:
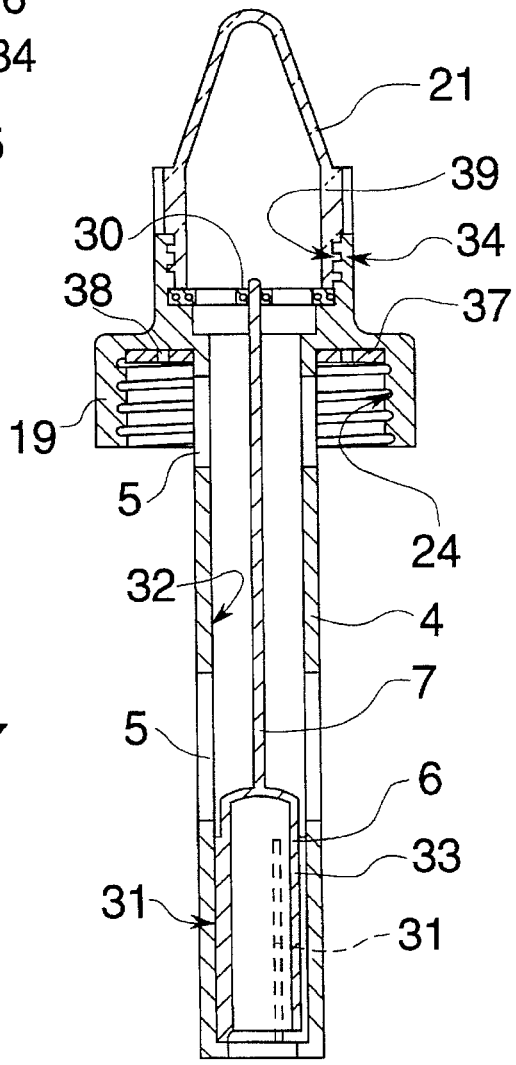
FIG. 7 shows a vertical section through a funnel tube as an alternative to FIG. 4.

The examples according to FIGS. 6 and 7 show how alternatives to the examples shown in FIGS. 1 through 5 can be developed.

In the example according to FIG. 6, the funnel 1 has external threaded section 34 on its connection piece 35, with which the funnel 1 can be screwed into an internal threaded section 39 of the funnel tube 4 instead of the transparent cap 21. In the example according to FIG. 6, the perforated plate 2 is supported at a step 36 of the funnel part 22, and it can therefore be pulled off in the upward direction.

The transparent cap 21 according to FIG. 7 is relatively short. It also has external threaded sections 34 for screwing into the screw socket 19.

Unlike in FIG. 4, the transparent cap 21 encloses an additional perforated disk 30, in which the measuring rod 7 is guided, even when the funnel 1 has been screwed off from the funnel tube 4.

This offers the advantage that by selecting the lengths of the funnel tube 4 and of the measuring rod 7, an indication of the emptying of the container 25 can be obtained. When the funnel tube 4 comes into contact with the bottom of the container 25 or with a raised bottom surface of the container 25 and the float 6 reaches its lowermost position during the emptying of the container 25, the upper edge of the measuring rod indicates that the container 25 is empty. In the case shown in FIG. 7, the measuring rod 7 projects only slightly above the additional perforated plate 30, and it signals the emptying of the container 25.

FIG. 7 also shows that the float 6 has a smaller external diameter than the hole of the funnel tube 4. However, a few float ribs 31 extending along the jacket lines of the float 6 are located on the outer jacket surface of the float 6. The float 6 is guided in the funnel tube 4 by means of these float ribs 31. A float vent gap 33, which makes it unnecessary to provide special vent holes 28, 29 according to FIGS. 5 and 6, is formed between the float ribs 31.

However, it is also possible to provide a sealing washer 37 with at least one vent hole 38. Thus, air can enter the tank from the outside through the threads of the internal threaded section 24 when a vacuum becomes established in it as a consequence of fuel being consumed.

Even though the transparent cap 21 according to FIG. 7 is substantially shorter than that shown in FIG. 4, it does not interfere with the position of the measuring rod 7 with the container filled. The measuring rod 7 strikes the top end of the cap and is pressed into the container.

While specific embodiments of the invention have been shown and described in detail to illustrate the application of the principles of the invention, it will be understood that the invention may be embodied otherwise without departing from such principles.

We claim:

1. A funnel comprising:

a funnel flare;

a funnel tube connected to said funnel flare at a downstream end of said funnel flare;

a float positioned inside said funnel tube and movable along an axis of said funnel tube;

a measuring rod connected to said float and extending upstream from said float;

a perforated plate mounted adjacent to a connection between said funnel tube and said funnel flare, said perforated plate surrounding and guiding said measuring rod along said axis of said funnel tube, said perforated plate being designed to be repetitively replaceable without damaging said perforated plate, said funnel tube and said funnel flare;

passage slots defined by said funnel tube, said passage slots being positioned downstream in said funnel tube of said perforated plate, an upstream side of said float having a dome shape and said perforated plate having a downstream side substantially complimentary to said dome shape to substantially block passage of fluid from said funnel flare to said funnel tube when said float is positioned against said perforated plate, said float being a hollow body open on a downstream side.

2. A funnel in accordance with claim 1, wherein:

an outer surface of said float and an inner surface of said funnel tube define a clearance gap to throttle fluid flowing through said funnel tube when said float is upstream of said passage slots.

3. A funnel in accordance with claim 1, wherein:

said funnel tube includes a step positioned at a downstream end of said funnel tube for blocking movement of said float in said funnel tube.

4. A funnel in accordance with claim 1, wherein:

one of said funnel tube and said funnel flare includes a step cooperating with said perforated plate to mount said perforated plate on said connection between said funnel flare and said funnel tube as a snap closure.

5. A funnel in accordance with claim 1, wherein:

said passage slots include an expansion opening having a magnitude larger than an upstream end and a downstream end of said passage slots, said expansion opening being positioned adjacent an upstream side of said float when said float is positioned at a downstream end of said funnel tube.

6. A funnel in accordance with claim 1, wherein:

said funnel tube includes a screw socket means for screwing said funnel tube onto a tank cap.

7. A funnel in accordance with claim 6, wherein:

said screw socket means forms a one-piece injection-molded plastic part with said funnel tube.

8. A funnel in accordance with claim 6, wherein:

said screw socket means includes a union nut and a collar connected to said funnel tube.

9. A funnel in accordance with claim 6, further comprising:

an additional perforated plate positioned in said screw socket means, said additional perforated plate defining a central hole for guiding said measuring rod.

10. A funnel in accordance with claim 9, wherein:

said additional perforated plate is supported in said funnel tube at a position to cause an upstream end of said measuring rod to be upstream of said additional perforated plate when said float is adjacent a downstream end of said funnel tube.

11. A funnel in accordance with claim 1, wherein:

said float includes a plurality of float ribs for guiding said float on an inner surface of said funnel tube, an outer surface of said float, said inner surface of said funnel tube, and said float ribs defining a float vent gap.

12. A funnel in accordance with claim 1, wherein:

said measuring rod and said funnel tube have a length to cause a lowermost position of said measuring rod to indicate a substantially empty state of a container.

13. A funnel in accordance with claim 1, wherein:

said funnel tube includes a holder means for guiding and attaching a transparent cap to said funnel tube, said transparent cap surrounding said measuring rod in a substantially moisture-proof manner.

14. A funnel in accordance with claim 13, wherein said funnel flare is removably connected to said funnel tube.

15. A funnel in accordance with claim 1, wherein:

one of said funnel flare and said funnel tube include ribs on a respective outer surface to form vent gaps between said respective outer surface and adjacent said ribs.

16. A funnel comprising:

a funnel flare;

funnel tube connected to said funnel flare at a downstream end of said funnel flare;

float positioned inside said funnel tube and movable along an axis of said funnel tube;

a measuring rod connected to said float and extending upstream from said float;

a perforated plate mounted adjacent to a connection between said funnel tube and said funnel flare, said perforated plate surrounding and guiding said measuring rod along said axis of said funnel tube, said perforated plate being designed to be repetitively replaceable without damaging said perforated plate, said funnel tube and said funnel flare;

passage slots defined by said funnel tube, said passage slots being positioned downstream in said funnel tube of said perforated plate, said passage slots having an upstream end positioned substantially at a downstream end of said float when said float is positioned adjacent to said perforated plate.

17. A funnel comprising:.

a funnel flare;

a funnel tube connected to said funnel flare at a downstream end of said funnel flare;

a piston-like float positioned inside said funnel tube and movable along an axis of said funnel tube;

a measuring rod connected to said float and extending upstream from said float;

a perforated plate mounted adjacent to a connection between said funnel tube and said funnel flare, said perforated plate surrounding and guiding said measuring rod along said axis of said funnel tube;

passage slots defined by said funnel tube; and a reference rod positioned in said funnel flare and extending substantially parallel to said measuring rod, an upstream side of said float having a dome shape and said perforated plate having a downstream side substantially complimentary to said dome shape to substantially block passage of fluid from said funnel flare to said funnel tube when said float is positioned against said perforated plate, said perforated plate acting as an upstream stop for said float and said connected measuring rod and a downstream stop being provided in said funnel tube for limiting movement of said float, and said connected measuring rod, in a downstream direction.

18. A funnel in accordance with claim 17, wherein:

an upstream end of said reference rod is positioned downstream of an upstream end of said measuring rod, when said float is positioned adjacent said perforated plate.

19. A funnel in accordance with claim 17, wherein:

said reference rod is connected to said perforated plate.

20. A funnel in accordance with claim 17, wherein:

said funnel tube includes a screw socket means for screwing said funnel tube onto a tank element.

* * * * *